US009359906B2

(12) United States Patent
Drozdenko et al.

(10) Patent No.: US 9,359,906 B2
(45) Date of Patent: Jun. 7, 2016

(54) ROTOR BLADE ROOT SPACER WITH A FRACTURE FEATURE

(71) Applicant: United Technologies Corporation, Hartford, CT (US)

(72) Inventors: Lee Drozdenko, Bristol, CT (US); William R. Graves, Manchester, CT (US)

(73) Assignee: United Technologies Corporation, Farmington, CT (US)

( * ) Notice: Subject to any disclaimer, the term of this patent is extended or adjusted under 35 U.S.C. 154(b) by 834 days.

(21) Appl. No.: 13/718,719

(22) Filed: Dec. 18, 2012

(65) Prior Publication Data

US 2014/0169975 A1 Jun. 19, 2014

(51) Int. Cl.
*F01D 5/30* (2006.01)
*F01D 21/04* (2006.01)

(52) U.S. Cl.
CPC ..... *F01D 5/3007* (2013.01); *F01D 5/3092* (2013.01); *F01D 21/045* (2013.01)

(58) Field of Classification Search
CPC ..... F01D 21/045; F01D 5/30; F01D 5/3007; F01D 5/3092; F01D 5/326
USPC ..... 415/9
See application file for complete search history.

(56) References Cited

U.S. PATENT DOCUMENTS 4,995,788 A * 2/1991 Turnberg ..... F01D 5/282 416/229 A
5,080,556 A 1/1992 Carreno
5,240,375 A 8/1993 Wayte
6,481,971 B1 11/2002 Forester
6,582,195 B2 6/2003 Davidson
6,846,159 B2 1/2005 Zabawa et al.
7,458,780 B2 12/2008 Weisse et al.
7,993,105 B2 8/2011 Weisse et al.
8,167,566 B2 5/2012 Howes
8,430,623 B2 * 4/2013 Beckford ..... F01D 5/14 415/9
8,568,082 B2 * 10/2013 Beckford ..... F01D 5/147 415/9
2004/0076523 A1 4/2004 Sinha et al.
2005/0207892 A1 * 9/2005 Kanebako ..... F01D 5/081 416/219 R
2005/0254951 A1 11/2005 Thenaisie et al.
2007/0048140 A1 3/2007 Farr et al.
2009/0004017 A1 * 1/2009 Belmonte ..... F01D 5/3092 416/219 R (Continued)

OTHER PUBLICATIONS

International search report for PCT/US2013/076171 dated Apr. 7, 2014.
International search report for PCT/US2013/076147 dated Apr. 9, 2014.

*Primary Examiner* — Nathaniel Wiehe
*Assistant Examiner* — Woody A Lee, Jr.
(74) *Attorney, Agent, or Firm* — O'Shea Getz P.C.

(57) ABSTRACT

A rotor assembly is provided that includes a rotor disk, a rotor blade and a root spacer. The rotor disk includes a slot. The rotor blade includes a blade root that is arranged within the slot. The root spacer is arranged within the slot between the rotor disk and the blade root. The root spacer includes a base segment, a side segment and a fracture feature. The base segment radially engages the rotor disk. The side segment is radially separated from the rotor disk by a gap. The fracture feature may radially fracture the root spacer at an intersection between the base segment and the side segment.

20 Claims, 6 Drawing Sheets

(56) References Cited

U.S. PATENT DOCUMENTS

| | | | |
|---|---|---|---|
| 2009/0060745 | A1 | 3/2009 | Douguet et al. |
| 2011/0150657 | A1 | 6/2011 | Millier et al. |
| 2011/0211965 | A1 | 9/2011 | Deal et al. |
| 2011/0211967 | A1 | 9/2011 | Deal et al. |
| 2011/0305576 | A1 | 12/2011 | Ward et al. |
| 2012/0301292 | A1 | 11/2012 | Deal et al. |

* cited by examiner

ROTOR BLADE ROOT SPACER WITH A FRACTURE FEATURE

CROSS-REFERENCE TO RELATED APPLICATIONS

This application is related to U.S. Patent Application Ser. No. 13/718,776, which is hereby incorporated herein by reference in its entirety.

BACKGROUND OF THE INVENTION

1. Technical Field

This disclosure relates generally to rotational equipment and, more particularly, to a root spacer for arranging between a rotor disk and a root of a rotor blade.

2. Background Information

A fan assembly for a typical turbine engine includes a plurality of fan blades arranged circumferentially around a rotor disk. Each of the fan blades may include an airfoil connected to a dovetail root. The root is inserted into a respective dovetail slot within the rotor disk to connect the fan blade to the rotor disk. A radial height of the root is typically less than a radial height of the slot. A gap therefore extends between a radial inner surface of the root and a radial inner surface of the slot. Such a gap is typically filled with a root spacer, which is sometimes also referred to as a fan blade spacer.

A typical root spacer is configured to reduce slippage and wear between the root and the rotor disk during engine operation where centrifugal loading on the fan blade is relatively low; e.g., during wind milling. By filling the gap, for example, the root spacer reduces space that would otherwise be available for rotating of the root within the slot. Such a rigid connection between the rotor disk and the fan blade, however, may increase internal stresses on the fan blade where an object such as a bird or a released fan blade collides with the fan blade.

There is a need in the art for an improved rotor spacer.

SUMMARY OF THE DISCLOSURE

According to an aspect of the invention, a rotor assembly is provided that includes a rotor disk, a rotor blade and a root spacer. The rotor disk includes a slot. The rotor blade includes a blade root arranged within the slot. The root spacer is arranged within the slot between the rotor disk and the blade root. The root spacer includes a base segment, a side segment and a groove. The base segment radially engages the rotor disk. The side segment is radially separated from the rotor disk by a gap. The groove extends radially into the root spacer at an intersection between the base segment and the side segment.

According to another aspect of the invention, another rotor assembly is provided that includes a rotor disk, a rotor blade and a root spacer. The rotor disk includes a slot. The rotor blade includes a blade root arranged within the slot. The root spacer is arranged within the slot between the rotor disk and the blade root. The root spacer includes a base segment, a side segment and a fracture feature. The base segment radially engages the rotor disk. The side segment is radially separated from the rotor disk by a gap. The fracture feature is adapted to radially fracture the root spacer at an intersection between the base segment and the side segment.

According to still another aspect of the invention, a turbine engine is provided that includes a fan section, a compressor section, a combustor section and a turbine section, where these sections are arranged along an axis. The fan section includes a rotor disk, a fan blade and a root spacer. The rotor disk includes a slot. The fan blade includes a blade root arranged within the slot. The root spacer is arranged within the slot between the rotor disk and the blade root. The root spacer includes a base segment, a side segment and a fracture feature. The base segment radially engages the rotor disk. The side segment is radially separated from the rotor disk by a gap. The fracture feature is adapted to radially fracture the root spacer at an intersection between the base segment and the side segment.

The fracture feature may be adapted to break the side segment off of the base segment.

The fracture feature may include a groove that extends radially into the root spacer at the intersection between the base segment and the side segment.

The groove may be configured as a first groove that extends in a radial outwards direction into the root spacer. The fracture feature may include a second groove that extends in a radial inwards direction into the root spacer at the intersection between the base segment and the side segment.

The side segment may be configured as a first side segment, and the fracture feature may be configured as a first fracture feature. The root spacer may include a second side segment and a second fracture feature. The base segment may be arranged between the first side segment and the second side segment. The second side segment may be radially separated from the rotor disk by a gap. The second fracture feature may be adapted to radially fracture the root spacer at an intersection between the base segment and the second side segment.

The slot may extend longitudinally into (e.g., partially into or through) the rotor disk. The groove may extend longitudinally within the root spacer. Alternatively, the groove may extend longitudinally partially into or through the root spacer.

The side segment may radially engage the blade root.

The base segment may be radially separated from the blade root by a gap.

The intersection between the base segment and the side segment may be laterally offset from a centroid (e.g., a lateral centroid) of the blade root.

The groove may extend in a radial outwards direction into (e.g., partially into or through) the root spacer. The groove may be configured as a first groove. The root spacer may include a second groove that extends in a radial inwards direction into (e.g., partially into or through) the root spacer at the intersection between the base segment and the side segment.

The groove may extend in a radial inwards direction into (e.g., partially into or through) the root spacer.

The side segment may be configured as a first side segment, and the groove may be configured as a first groove. The root spacer may include a second side segment and a second groove. The base segment may be arranged between the first side segment and the second side segment. The second side segment may be radially separated from the rotor disk by a gap. The second groove may extend radially into the root spacer at an intersection between the base segment and the second side segment.

The rotor blade may be configured as a turbine engine fan blade.

The slot may be one of a plurality of slots that extend longitudinally into the rotor disk. The rotor blade may be one of a plurality of rotor blades that are arranged circumferentially around an axis. Each of the rotor blades may include a respective blade root that is arranged within a respective one of the slots. The root spacer may be one of a plurality of root spacers. Each of the root spacers may be arranged within a respective one of the slots between the rotor disk and a respective one of the blade roots.

The foregoing features and the operation of the invention will become more apparent in light of the following description and the accompanying drawings.

DETAILED DESCRIPTION OF THE INVENTION

Figure 1:
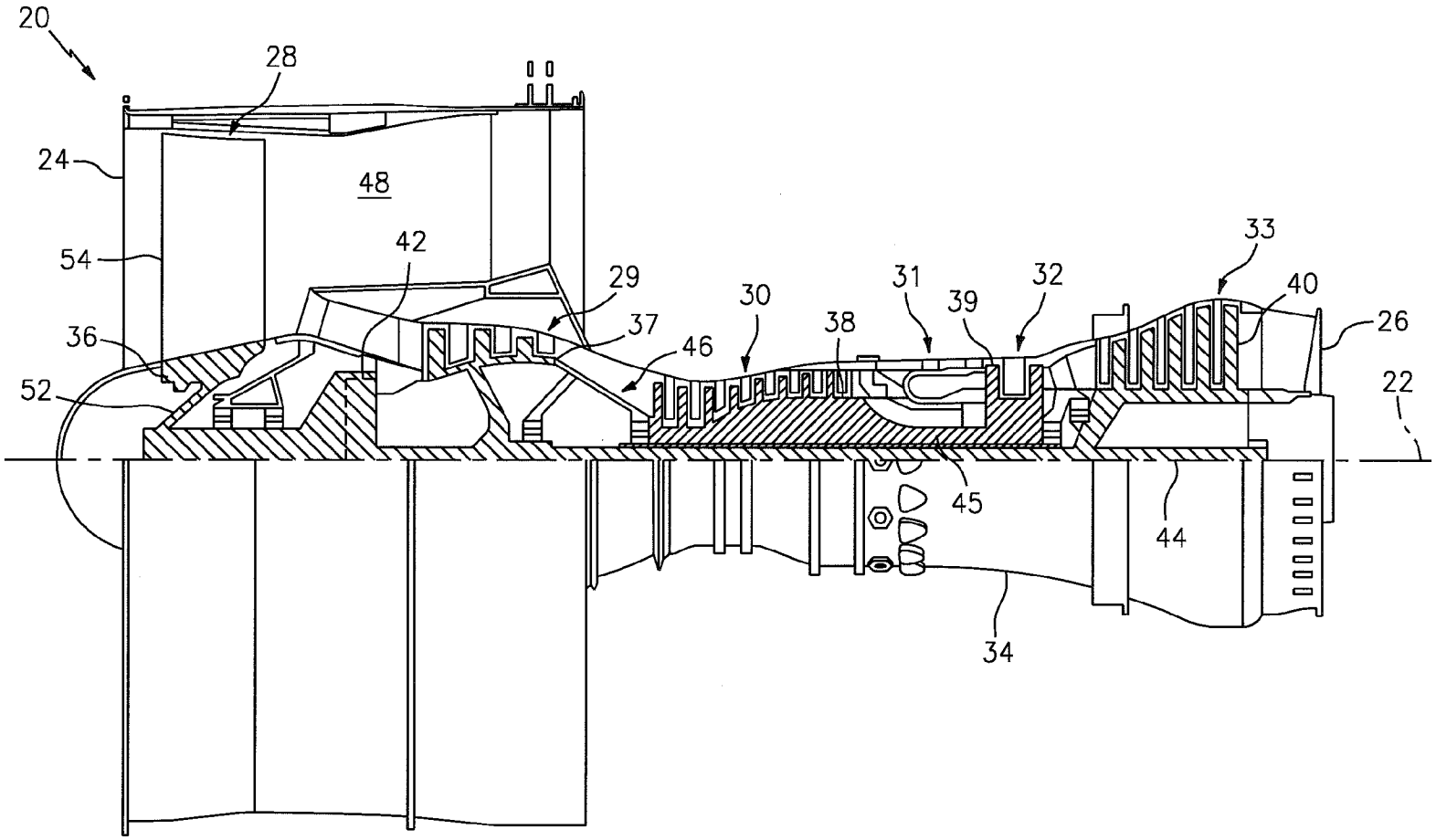
FIG. 1 is a side sectional illustration of a geared turbine engine.

FIG. 1 is a sectional illustration of a geared turbine engine 20 that extends along an axis 22 between a forward airflow inlet 24 and an aft airflow exhaust 26. The engine 20 includes a fan section 28, a low pressure compressor (LPC) section 29, a high pressure compressor (HPC) section 30, a combustor section 31, a high pressure turbine (HPT) section 32, and a low pressure turbine (LPT) section 33. These engine sections 28-33 are arranged sequentially along the axis 22 and housed within an engine case 34. Each of the engine sections 28-30, 32 and 33 includes a respective rotor 36-40. Each of the rotors 36-40 includes a plurality of rotor blades arranged circumferentially around and connected (e.g., mechanically fastened, welded, brazed or otherwise adhered) to one or more respective rotor disks. The fan rotor 36 is connected to a gear train 42. The gear train 42 and the LPC rotor 37 are connected to and driven by the LPT rotor 40 through a low speed shaft 44. The HPC rotor 38 is connected to and driven by the HPT rotor 39 through a high speed shaft 45.

Air enters the engine 20 through the airflow inlet 24, and is directed through the fan section 28 and into an annular core gas path 46 and an annular bypass gas path 48. The air within the core gas path 46 may be referred to as "core air". The air within the bypass gas path 48 may be referred to as "bypass air" or "cooling air". The core air is directed through the engine sections 29-33 and exits the engine 20 through the airflow exhaust 26. Within the combustion section 31, fuel is injected into and mixed with the core air and ignited to provide forward engine thrust. The bypass air is directed through the bypass gas path 48 and out of the engine 20 to provide additional forward engine thrust or reverse thrust via a thrust reverser. The bypass air may also be utilized to cool various turbine engine components within one or more of the engine sections 29-33.

Figure 2:
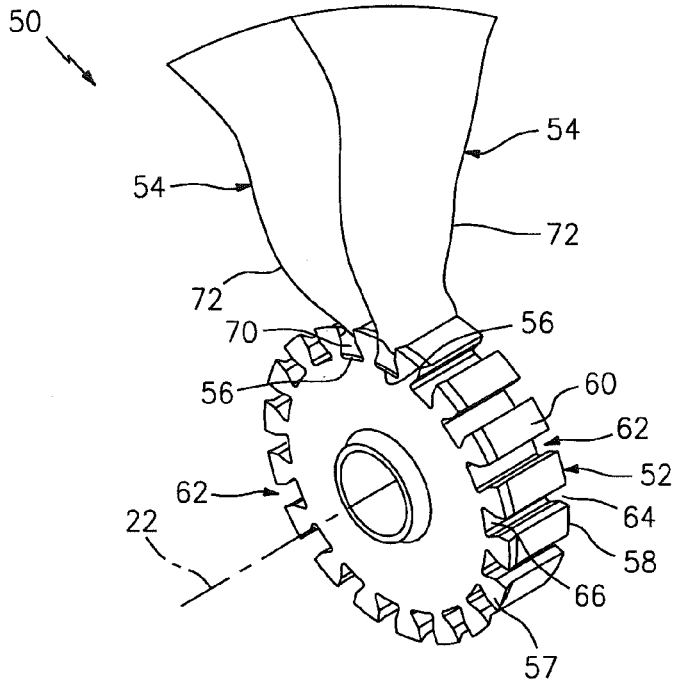
FIG. 2 is a perspective illustration of a partially assembled rotor assembly for the turbine engine of FIG. 1.

FIG. 2 is a perspective illustration of a partially assembled rotor assembly 50 for one of the rotors 36-40 (e.g., the fan rotor 36). In the embodiment of FIG. 2, the rotor assembly 50 includes the rotor disk 52, the rotor blades 54 (e.g., fan blades), and one or more root spacers 56 (e.g., fan blade spacers).

Figure 3:
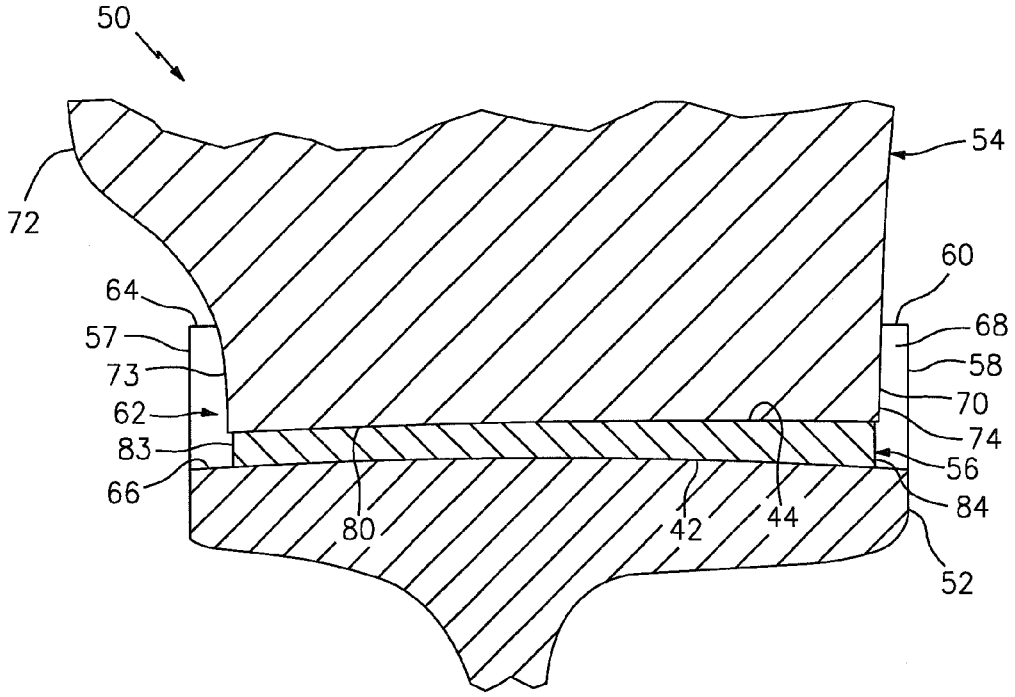
FIG. 3 is a side sectional illustration of a portion of the rotor assembly of FIG. 2.
Figure 4:
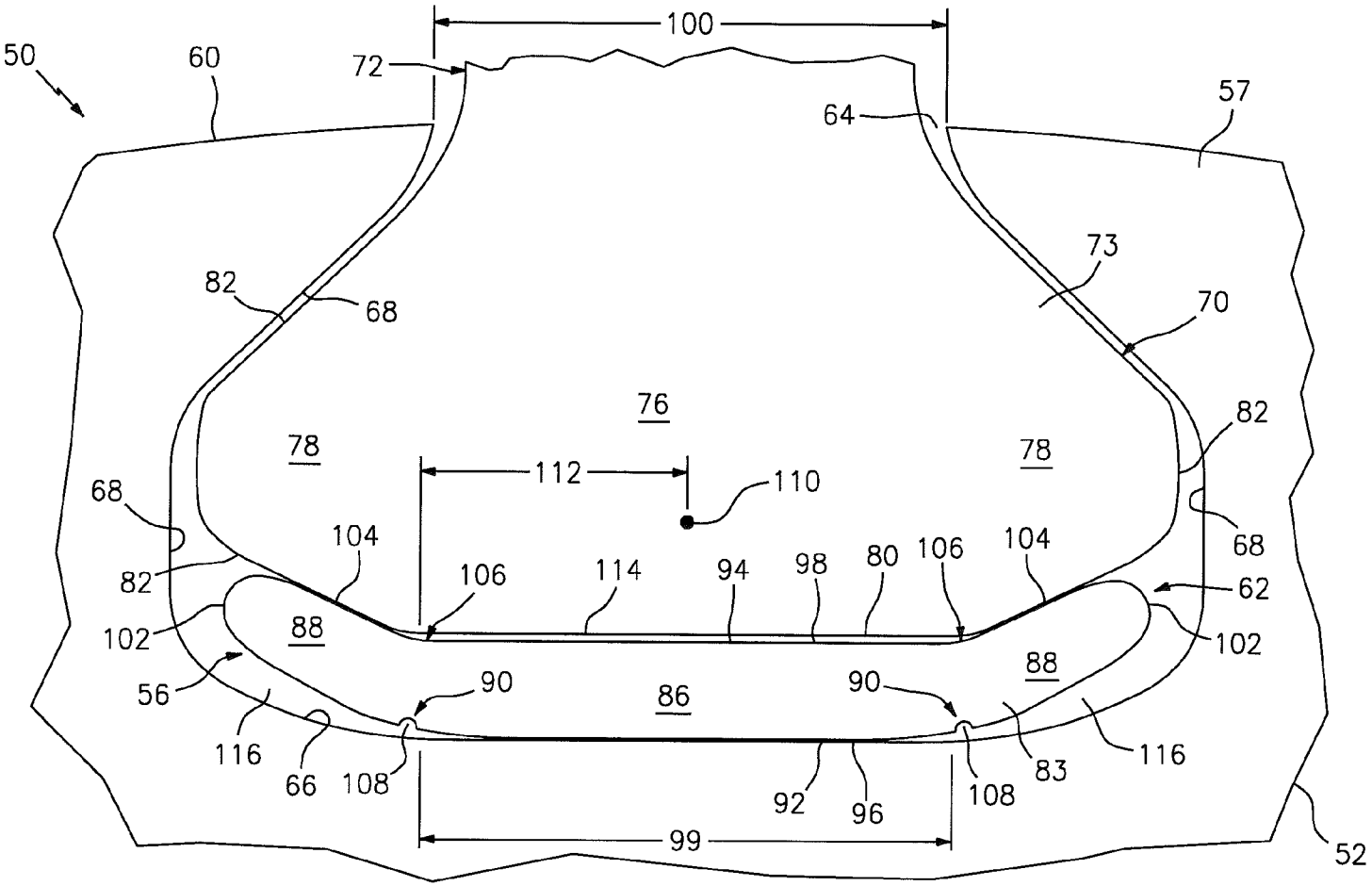
FIG. 4 is an illustration of an end of a portion of the rotor assembly of FIG. 2 during a first mode of operation.

The rotor disk 52 extends axially between a disk forward end 57 and a disk aft end 58. The rotor disk 52 extends radially out to a disk outer surface 60. The rotor disk 52 includes one or more slots 62 (e.g., dovetail slots) arranged circumferentially around the axis 22. Referring to FIG. 3, one or more of the slots 62 each extends longitudinally into the rotor disk 52; e.g., through the rotor disk 52 between the forward end 57 and the aft end 58. Referring now to FIG. 4, one or more of the slots 62 each extends radially into the rotor disk 52 from an opening 64 in the outer surface 60 to a slot base surface 66. One or more of the slots 62 each extends laterally (e.g., circumferentially or tangentially) between opposing slot side surfaces 68. The base surface 66 extends laterally between the side surfaces 68.

Referring to FIG. 3, one or more of the rotor blades 54 each includes a blade root 70 and an airfoil 72. The blade root 70 extends longitudinally between a root forward end 73 and a root aft end 74. Referring now to FIG. 4, the blade root 70 includes a root base segment 76 and a pair of root side segments 78. The base segment 76 extends radially between the airfoil 72 and a root base surface 80. The side segments 78 respectively extend laterally from the base segment 76 to opposing root side surfaces 82. The base surface 80 extends laterally between the side surfaces 82.

Figure 5:
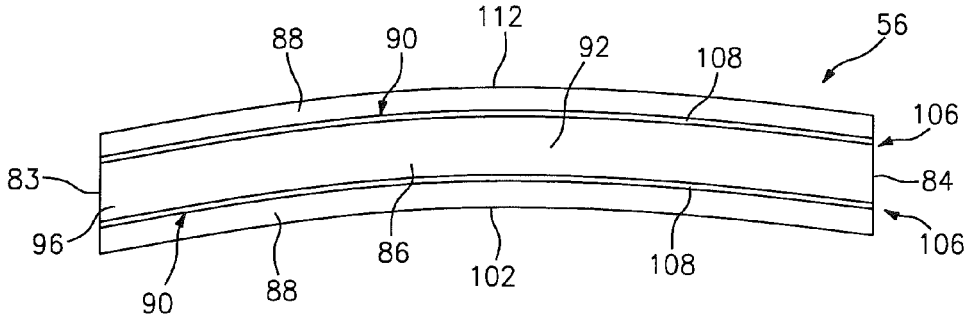
FIG. 5 is an illustration of an inner surface of a root spacer for the rotor assembly of FIG. 2.

Referring to FIGS. 4 and 5, one or more of the root spacers 56 each extends longitudinally between a spacer forward end 83 and a spacer aft end 84. One or more of the root spacers 56 each includes a spacer base segment 86, one or more spacer side segments 88, and one or more fracture features 90. The segments 86 and 88 extend radially between a spacer inner surface 92 and a spacer outer surface 94. The base segment 86 extends laterally between the side segments 88, and respectively defines base portions 96 and 98 of the inner and the outer surfaces 92 and 94. The outer base portion 98 may have a substantially flat cross-sectional geometry and a lateral width 99 that is substantially equal to a lateral width 100 of the opening 64. Each of the side segments 88 extends laterally from the base segment 86 to a respective spacer side surface 102. The side surfaces 102 extend radially between the inner and the outer surfaces 92 and 94. The side segments 88 respectively define side portions 104 of the outer surface 94. These side portions 104 may each have a substantially flat cross-sectional geometry that is angularly offset from the outer base portion 98 by, for example, between about 135 and about 160 degrees.

Each of the fracture features 90 is adapted to radially fracture (e.g., crack or otherwise break) the respective root spacer 56 at (e.g., on, adjacent or proximate) an intersection 106 between the base segment 86 and a respective one of the side segments 88. The fracture features 90 of FIGS. 4 and 5, for example, each include a groove 108 that extends, in a radial outwards direction, into the root spacer 56 at the intersection 106. The groove 108 also extends longitudinally through the root spacer 56 between the forward and the aft ends 83 and 84. This groove 108 may concentrate stress within the root spacer 56 at the respective intersection 106 during turbine engine operation, which may enable the root spacer 56 to fracture at the intersection 106 under certain conditions as described below.

Referring to FIG. 2, the rotor blades 54 are arranged circumferentially around the axis 22. The blade roots 70 and the root spacers 56 are respectively arranged within the slots 62. Referring to FIG. 4, the root side segments 78 extend laterally between the root base segment 76 and the rotor disk 52. The root side surfaces 82 may respectively engage (e.g., contact) the slot side surfaces 68. The root spacer 56 is arranged radially between the root 70 and the rotor disk 52. Each of the intersections 106 and, thus, each of the fracture features 90 is laterally offset from a centroid 110 (e.g., a lateral centroid) of the blade root 70 by a lateral distance 112. The side portions 104 of the spacer outer surface 94 respectively engage the root side surfaces 82. The spacer base segment 86 may be radially separated from the root base surface 80 by a gap 114. The inner base portion 96 of the spacer inner surface 92 may engage the slot base surface 66. The spacer side segments 88 are radially separated from the root base surface 66 by respective gaps 116.

Figure 6:
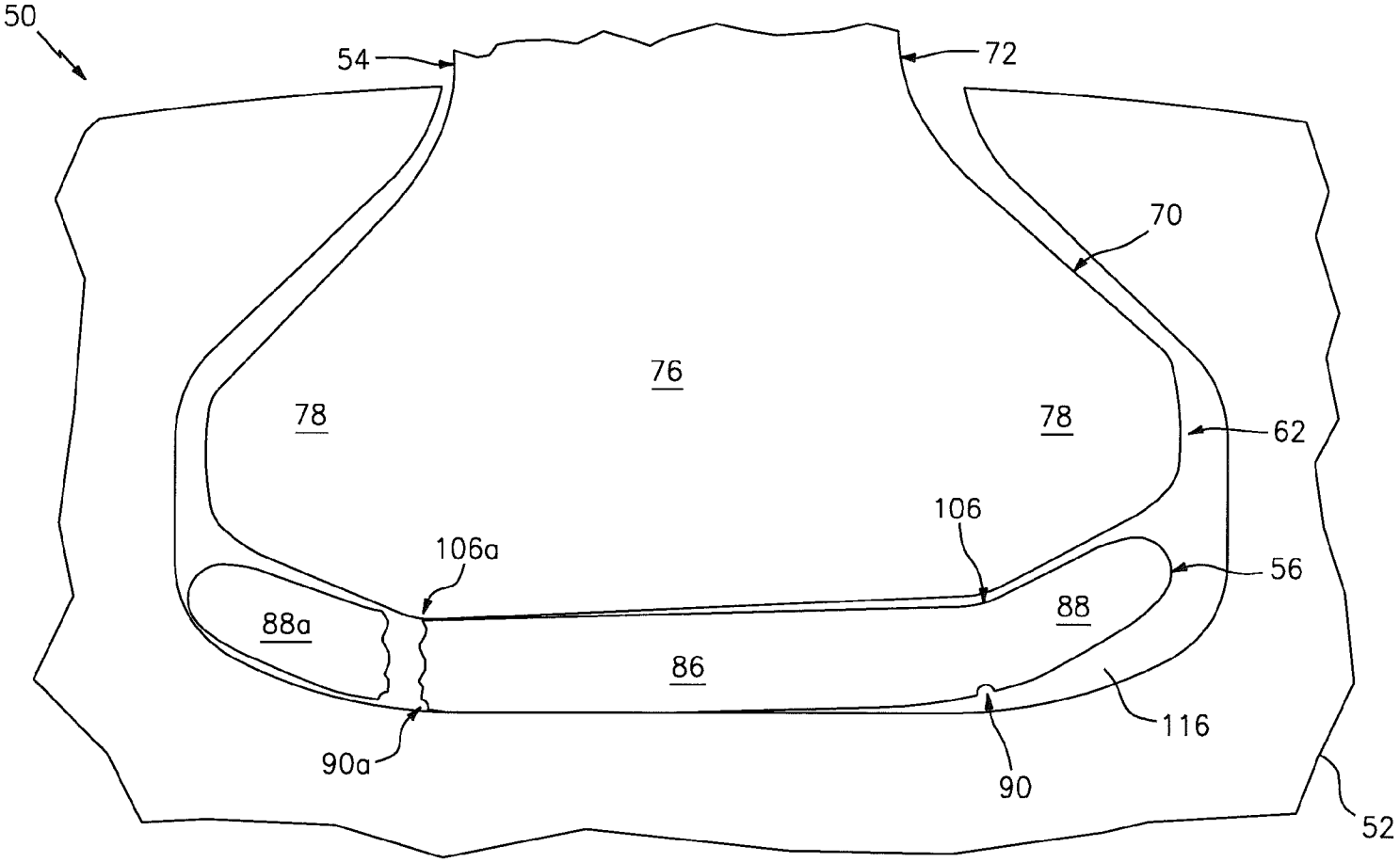
FIG. 6 is an illustration of an end of a portion of the rotor assembly of FIG. 2 during a second mode of operation.

FIG. 4 illustrates an end of a portion of the rotor assembly 50 during a first mode of operation; e.g., during nominal flight conditions. FIG. 6 illustrates an end of a portion of the rotor assembly 50 during a second mode of operation; e.g., during non-nominal flight conditions such as after a foreign object collides with one or more of the airfoils 72. During the first mode of operation of FIG. 4, the spacer side segments 88 substantially prevent the root 70 from rotating within the slot 62 by radially supporting the respective root side segments 78. In contrast, during the second mode of operation of FIG. 6, the root spacer 56 is fractured at the intersection 106*a* by a shock load generated by the collision of the foreign object against the airfoil 72. In particular, the spacer side segment 88*a* is broken off of the root spacer 56 where the fracture feature 90*a* concentrated the stress within the root spacer 56 at the intersection 106*a*. The root 70 therefore may rotate within the slot 62 enabling the rotor blade 54 to, for example, substantially absorb the shock load without breaking and causing additional harm to the engine 20.

Figure 7:
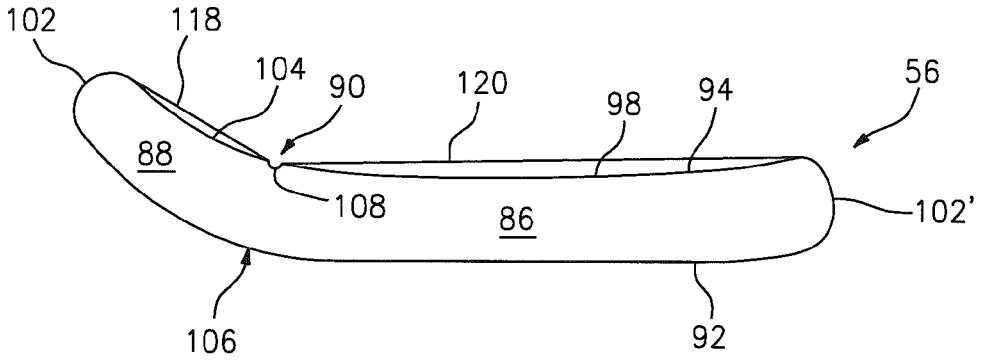
FIG. 7 is an illustration of an end of an alternative embodiment root spacer for the rotor assembly of FIG. 2.
Figure 8:
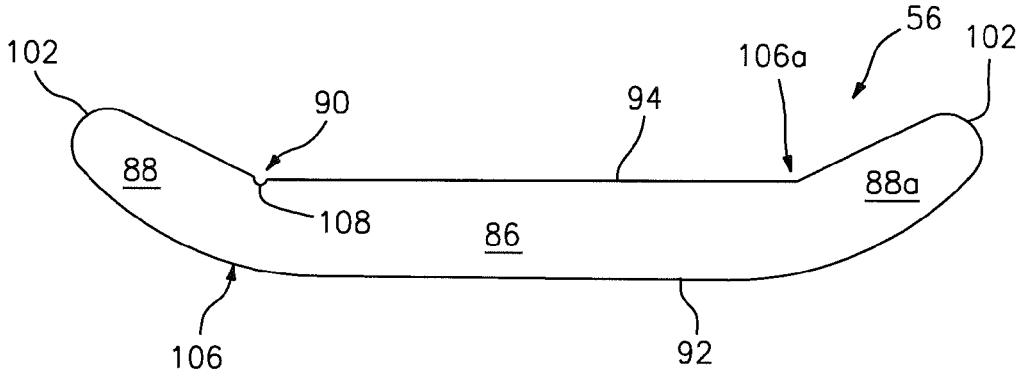
FIG. 8 is an illustration of an end of another alternative embodiment root spacer for the rotor assembly of FIG. 2.

One or more of the root spacers 56 may have various configurations other than those described above. One or more of the root spacers 56, for example as illustrated in FIG. 7, may omit one of the spacer side segments 88. The spacer base segment 86' therefore extends laterally between the spacer side segment 88 and the side surface 102'. In addition or alternatively, the base and/or side portions 98 and 104 of the spacer outer surface 94 may each have a curved cross-sectional geometry. In the embodiment of FIG. 7, the side portion 104 has a chord 118 that is angularly offset from a chord 120 of the base portion 98. Alternatively, as illustrated in FIG. 8, the intersection 106*a* between one of the spacer side segments 88*a* and the spacer base segment 86 may be configured without a fracture feature. The present invention therefore is not limited to any particular root spacer configurations.

The root spacers may be constructed from a variety of materials such as metal and/or polymer. The present invention therefore is not limited to any particular root spacer materials.

Figure 10:
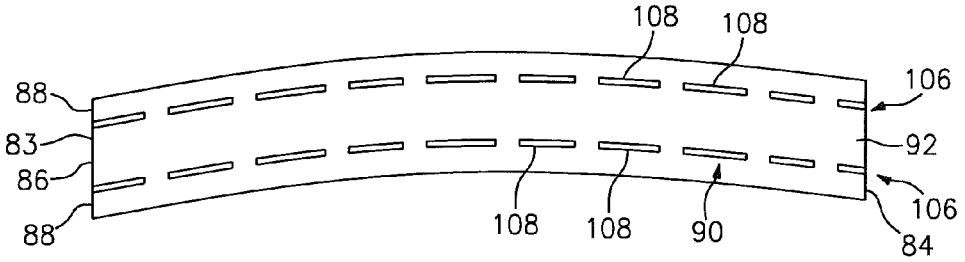
FIG. 10 is an illustration of an inner surface of another alternative embodiment root spacer for the rotor assembly of FIG. 2.
Figure 11:
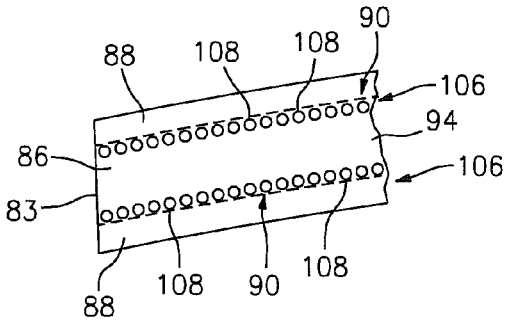
FIG. 11 is an illustration of a portion of an outer surface of another alternative embodiment root spacer for the rotor assembly of FIG. 2.
Figure 9:
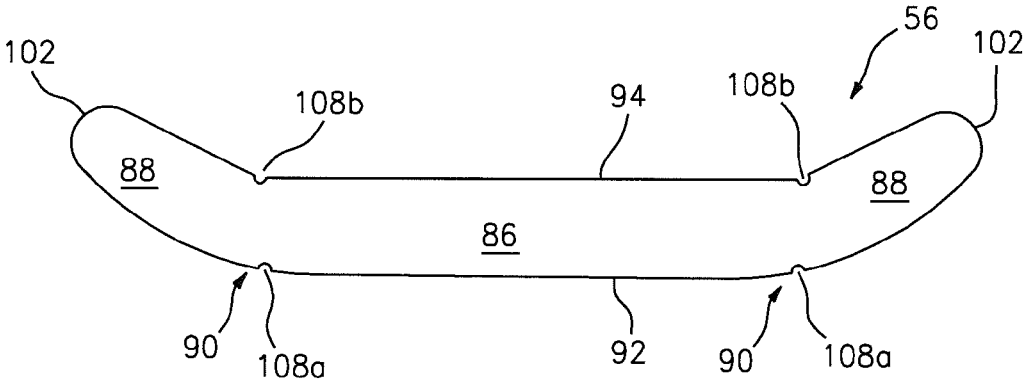
FIG. 9 is an illustration of an end of another alternative embodiment root spacer for the rotor assembly of FIG. 2.

One or more of the fracture features 90 may each have various configurations other than those described above. Each groove 108, for example, may extend in a radial inwards direction into the respective root spacer 56 as shown in FIGS. 7 and 8. Alternatively, as illustrated in FIG. 9, one or more of the fracture features 90 may each include a plurality of grooves 108*a* and 108*b*. One of the grooves 108*a* may extend in the radial outwards direction into the root spacer 56, and another one of the grooves 108*b* may extend in the radial inwards direction into the root spacer 56. In addition or alternatively, as illustrated in FIGS. 10 and 11, one or more the grooves 108 may extend longitudinally within (e.g., partially through) the root spacer 56. In some embodiments, one or more of the grooves 108 may have asymmetrical (e.g., arcuate of rectangular) or symmetrical (e.g., circular or square) geometries. In some embodiments, one or more of the grooves 108 may extend partially into or through the root spacer 56. The present invention therefore is not limited to any particular fracture feature configurations.

The terms "upstream", "downstream", "inner" and "outer" are used to orientate the components of the rotor assembly 50 described above relative to the turbine engine 20 and its axis 22. A person of skill in the art will recognize, however, the rotor assembly components such as the root spacer 56 may be utilized in other orientations than those described above. The present invention therefore is not limited to any particular rotor assembly or root spacer spatial orientations.

A person of skill in the art will recognize the rotor assembly 50 may be included in one or more sections of the engine 20 other than the fan section 28 as well as in various turbine engines other than that described above. A person of skill in the art will also recognize the rotor assembly 50 may be included in various types of rotational equipment other than a turbine engine. The present invention therefore is not limited to any particular types or configurations of rotational equipment.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. A rotor assembly, comprising:

a rotor disk including a slot;

a rotor blade including a blade root arranged within the slot; and a root spacer arranged within the slot between the rotor disk and the blade root, the root spacer including a base segment, a side segment and a groove, wherein the base segment radially engages the rotor disk;

the side segment is radially separated from the rotor disk defining a gap; and the groove extends radially into the root spacer at an intersection between the base segment and the side segment.

2. The rotor assembly of claim 1, wherein the slot extends longitudinally into the rotor disk; and the groove extends longitudinally within the root spacer.

3. The rotor assembly of claim 2, wherein the groove extends longitudinally through the root spacer.

4. The rotor assembly of claim 1, wherein the side segment radially engages the blade root.

5. The rotor assembly of claim 1, wherein the base segment is radially separated from the blade root by a gap.

6. The rotor assembly of claim 1, wherein the intersection between the base segment and the side segment is laterally offset from a centroid of the blade root.

7. The rotor assembly of claim 1, wherein the groove extends in a radial outwards direction into the root spacer.

8. The rotor assembly of claim 7, wherein the groove comprises a first groove, and the root spacer further includes a second groove; and the second groove extends in a radial inwards direction into the root spacer at the intersection between the base segment and the side segment.

9. The rotor assembly of claim 1, wherein the groove extends in a radial inwards direction into the root spacer.

10. The rotor assembly of claim 1, wherein the side segment comprises a first side segment, the groove comprises a first groove, and the root spacer further includes a second side segment that defines a second groove;

the base segment is arranged between the first side segment and the second side segment;

the second side segment is radially separated from the rotor disk by a gap; and the second groove extends radially into the root spacer at an intersection between the base segment and the second side segment.

11. The rotor assembly of claim 1, wherein the rotor blade comprises a turbine engine fan blade.

12. The rotor assembly of claim 1, wherein the slot is one of a plurality of slots that extend longitudinally into the rotor disk;

the rotor blade is one of a plurality of rotor blades that are arranged circumferentially around an axis, and each of the rotor blades includes a respective blade root that is arranged within a respective one of the slots; and the root spacer is one of a plurality of root spacers, and each of the root spacers is arranged within a respective one of the slots between the rotor disk and a respective one of the blade roots.

13. A rotor assembly, comprising:

a rotor disk including a slot;

a rotor blade including a blade root arranged within the slot; and a root spacer arranged within the slot between the rotor disk and the blade root, the root spacer including a base segment, a side segment and a fracture feature, wherein the base segment radially engages the rotor disk;

the side segment is radially separated from the rotor disk by a gap; and the fracture feature is adapted to radially fracture the root spacer at an intersection between the base segment and the side segment.

14. The rotor assembly of claim 13, wherein the fracture feature is adapted to break the side segment off of the base segment.

15. The rotor assembly of claim 13, wherein the fracture feature defines a groove that extends radially into the root spacer at the intersection between the base segment and the side segment.

16. The rotor assembly of claim 15, wherein the groove extends in a radial outwards direction into the root spacer.

17. The rotor assembly of claim 16, wherein the groove comprises a first groove, and the fracture feature defines a second groove; and the second groove extends in a radial inwards direction into the root spacer at the intersection between the base segment and the side segment.

18. The rotor assembly of claim 13, wherein the side segment comprises a first side segment, the fracture feature comprises a first fracture feature, and the root spacer further includes a second side segment and a second fracture feature;

the base segment is arranged between the first side segment and the second side segment;

the second side segment is radially separated from the rotor disk by a gap; and the second fracture feature is adapted to radially fracture the root spacer at an intersection between the base segment and the second side segment.

19. A turbine engine, comprising:

a fan section, a compressor section, a combustor section and a turbine section arranged along an axis, the fan section including a rotor disk, a fan blade and a root spacer;

the rotor disk including a slot;

the fan blade including a blade root arranged within the slot; and the root spacer arranged within the slot between the rotor disk and the blade root, the root spacer including a base segment, a side segment and a fracture feature, wherein the base segment radially engages the rotor disk;

the side segment is radially separated from the rotor disk by a gap; and the fracture feature is adapted to radially fracture the root spacer at an intersection between the base segment and the side segment.

20. The engine of claim 19, wherein the fracture feature includes a groove that extends radially into the root spacer at the intersection between the base segment and the side segment.

* * * * *